US010900323B2

(12) United States Patent
Kent

(10) Patent No.: US 10,900,323 B2
(45) Date of Patent: Jan. 26, 2021

(54) METHOD AND STIMULATION SLEEVE FOR WELL COMPLETION IN A SUBTERRANEAN WELLBORE

(71) Applicant: ENTECH SOLUTION AS, Games (NO)

(72) Inventor: Anthony Kent, Houston, TX (US)

(73) Assignee: Entech Solutions AS

( * ) Notice: Subject to any disclaimer, the term of this patent is extended or adjusted under 35 U.S.C. 154(b) by 221 days.

(21) Appl. No.: 15/892,075

(22) Filed: Feb. 8, 2018

(65) Prior Publication Data

US 2019/0136666 A1 May 9, 2019

(30) Foreign Application Priority Data

Nov. 6, 2017 (NO) ..... 20171752

(51) Int. Cl.

| | |
|---|---|
| ***E21B 34/14*** | (2006.01) |
| ***E21B 34/10*** | (2006.01) |
| ***E21B 34/06*** | (2006.01) |
| ***E21B 43/14*** | (2006.01) |
| ***E21B 43/26*** | (2006.01) |

(52) U.S. Cl.

CPC ..... *E21B 34/108* (2013.01); *E21B 34/063* (2013.01); *E21B 43/14* (2013.01); *E21B 43/26* (2013.01); *E21B 2200/06* (2020.05)

(58) Field of Classification Search

CPC .... E21B 2034/007; E21B 34/14; E21B 34/10; E21B 34/063; E21B 43/26

See application file for complete search history.

(56) References Cited

U.S. PATENT DOCUMENTS

| | | | |
|---|---|---|---|
| 5,421,414 | A | 6/1995 | Lane |
| 5,509,442 | A | 4/1996 | Claycomb |
| 5,794,699 | A | 8/1998 | Hammet |
| 5,813,457 | A | 9/1998 | Giroux |
| 7,243,723 | B2 | 7/2007 | Surjaatmadja |

(Continued)

FOREIGN PATENT DOCUMENTS

| | | | |
|---|---|---|---|
| BR | 102015003617 | A2 | 12/2015 |
| CA | 2882582 | C | 3/2014 |

(Continued)

OTHER PUBLICATIONS

Norwegian Search Report (NO Appl. No. 20171752), dated Jun. 6, 2018.

*Primary Examiner* — Kipp C Wallace
(74) *Attorney, Agent, or Firm* — Dossey & Jones, PLLC; Phillip Black

(57) ABSTRACT

Stimulation sleeve (1) for well intervention in a subterranean wellbore, comprising: a housing (10) having a through channel (11) with a first end (11*a*) and a second end (11*b*), and one or more flow ports (14), and a sliding sleeve (13) disposed axially movable within the housing (10) to open or close said flow ports (14). Said sliding sleeve (13) is equipped with at least a first obturator seat (15) for receipt of a obturator (17) to partially or fully close fluid communication in the through channel (11) of the housing (10), and a time delay mechanism (20) to allow the sliding sleeve (13) to axially travel in the housing (10) at a predetermined speed to open or close said flow ports (14). The invention also discloses a method for well completion in a subterranean wellbore using a sliding sleeve (1).

3 Claims, 11 Drawing Sheets

(56) References Cited

U.S. PATENT DOCUMENTS

| | | | |
|---|---|---|---|
| 7,398,832 | B2 | 7/2008 | Brisco |
| 7,416,029 | B2 | 8/2008 | Telfer |
| 7,681,645 | B2 | 3/2010 | McMillin |
| 7,740,072 | B2 | 6/2010 | Surjaatmadja |
| 7,770,652 | B2 | 8/2010 | Barnett |
| 7,779,911 | B2 | 8/2010 | Akselberg |
| 7,798,236 | B2 | 9/2010 | McKeachnie |
| 7,814,981 | B2 | 10/2010 | Marcu |
| 7,909,108 | B2 | 3/2011 | Swor |
| 7,946,340 | B2 | 5/2011 | Surjaatmadia |
| 8,201,634 | B2 | 6/2012 | Laurel |
| 8,215,411 | B2 | 7/2012 | Flores |
| 8,245,788 | B2 | 8/2012 | Garcia |
| 8,276,675 | B2 | 10/2012 | Williamson et al. |
| 8,505,639 | B2 | 8/2013 | Robison et al. |
| 8,662,178 | B2 | 3/2014 | Norrid |
| 8,668,016 | B2 | 3/2014 | Porter et al. |
| 8,733,449 | B2 | 5/2014 | Ehtesham |
| 8,757,273 | B2 | 6/2014 | Themig et al. |
| 8,844,622 | B2 | 9/2014 | Telfer |
| 8,893,810 | B2 | 11/2014 | Zimmerman |
| 8,899,334 | B2 | 12/2014 | Merron et al. |
| 8,919,434 | B2 | 12/2014 | Brekke |
| 8,931,565 | B2 | 1/2015 | Desranleau et al. |
| 8,978,773 | B2 | 3/2015 | Tilley |
| 8,991,509 | B2 | 3/2015 | Merron |
| 9,016,376 | B2 | 4/2015 | Surjaatmadja |
| 9,121,273 | B2 | 9/2015 | Norrid |
| 9,169,707 | B1 | 10/2015 | Gilstad |
| 9,187,978 | B2 | 11/2015 | Castro |
| 9,260,935 | B2 | 2/2016 | Murphree |
| 9,273,534 | B2 | 3/2016 | Merron |
| 9,334,710 | B2 | 5/2016 | Pacey et al. |
| 9,369,877 | B2 | 6/2016 | Stout |
| 9,371,318 | B2 | 6/2016 | Morrison |
| 9,394,773 | B2 | 7/2016 | Garcia |
| 9,428,976 | B2 | 8/2016 | Porter |
| 9,458,697 | B2 | 10/2016 | Howell et al. |
| 9,464,501 | B2 | 10/2016 | Kristoff |
| 9,464,506 | B2 | 10/2016 | Coon |
| 9,523,261 | B2 | 12/2016 | Flores |
| 9,528,835 | B2 | 12/2016 | Russo |
| 9,562,419 | B2 | 2/2017 | Fleckenstein et al. |
| 9,617,816 | B1 | 4/2017 | Sullivan |
| 9,637,977 | B2 | 5/2017 | Giroux |
| 9,644,464 | B2 | 5/2017 | Jani |
| 9,650,866 | B2 | 5/2017 | George |
| 9,714,557 | B2 | 6/2017 | Garcia |
| 9,702,221 | B2 | 7/2017 | Hofman |
| 9,702,222 | B2 | 7/2017 | Hardesty |
| 9,708,867 | B2 | 7/2017 | Lovell |
| 9,759,039 | B1 | 9/2017 | Hardesty |
| 9,759,044 | B2 | 9/2017 | Castro |
| 9,765,595 | B2 | 9/2017 | Thernig |
| 9,784,070 | B2 | 10/2017 | Neer et al. |
| 9,835,004 | B2 | 12/2017 | Keerthivasan |
| 9,840,890 | B2 | 12/2017 | Nordheimer |
| 9,840,892 | B2 | 12/2017 | Nordheimer |
| 9,856,718 | B2 | 1/2018 | Broussard |
| 9,874,067 | B2 | 1/2018 | Themig |
| 9,890,610 | B2 | 2/2018 | Jordan |
| 9,926,769 | B2 | 3/2018 | Wood |
| 9,926,773 | B2 | 3/2018 | Hallundbaek |
| 9,951,596 | B2 | 4/2018 | Lynk |
| 2004/0163820 | A1* | 8/2004 | Bishop ..... E21B 34/06 166/373 |
| 2010/0175891 | A1 | 7/2010 | Rondeau |
| 2012/0234545 | A1* | 9/2012 | Xu ..... E21B 43/26 166/308.1 |
| 2013/0081817 | A1 | 4/2013 | Norrid et al. |
| 2013/0233535 | A1* | 9/2013 | Pacey ..... E21B 34/14 166/206 |
| 2014/0000909 | A1* | 1/2014 | Neer ..... E21B 34/108 166/373 |
| 2014/0083680 | A1* | 3/2014 | Brekke ..... E21B 34/063 166/250.01 |
| 2015/0136403 | A1 | 5/2015 | Cheng |
| 2015/0226031 | A1 | 8/2015 | Hekeloar |
| 2015/0354320 | A1 | 12/2015 | Mahajan |
| 2015/0369009 | A1 | 12/2015 | George |
| 2016/0084079 | A1 | 3/2016 | Zhou |
| 2016/0130914 | A1 | 5/2016 | Steele |
| 2016/0177657 | A1 | 6/2016 | Howell |
| 2016/0237781 | A1 | 8/2016 | Bacsik |
| 2016/0258260 | A1 | 9/2016 | Walton |
| 2017/0030159 | A1 | 2/2017 | Vick |
| 2017/0030168 | A1 | 2/2017 | Akkerman |
| 2017/0044870 | A1 | 2/2017 | Kellner |
| 2017/0058642 | A1 | 3/2017 | Roessler et al. |
| 2017/0067314 | A1 | 3/2017 | Flores Perez |
| 2017/0175488 | A1 | 6/2017 | Lisowski |
| 2017/0234107 | A1 | 8/2017 | Atilano |
| 2017/0241238 | A1* | 8/2017 | Bacsik ..... E21B 43/14 |
| 2017/0260813 | A1 | 9/2017 | SadAbadi |
| 2018/0010424 | A1 | 1/2018 | Hawkins |
| 2018/0073305 | A1 | 3/2018 | Downing |
| 2018/0119517 | A1* | 5/2018 | Hered ..... E21B 34/10 |
| 2018/0163508 | A1 | 6/2018 | Kellner |
| 2018/0171737 | A1 | 6/2018 | Xu |

FOREIGN PATENT DOCUMENTS

| | | | |
|---|---|---|---|
| CA | 2886434 | C | 3/2015 |
| CA | 2016050316 | A1 | 9/2016 |
| CA | 2939553 | A1 | 2/2017 |
| CA | 3001303 | A1 | 4/2017 |
| CA | 2986338 | A1 | 2/2018 |
| EP | 2015051125 | A2 | 7/2015 |
| GB | 2448632 | A1 | 1/2009 |
| GB | 2546996 | A1 | 9/2017 |
| NO | 20171586 | A1 | 10/2017 |
| NO | 20171731 | A1 | 10/2017 |
| NO | 20180175 | A1 | 2/2018 |
| WO | 2014055332 | A1 | 4/2014 |
| WO | 2015039697 | A1 | 3/2015 |
| WO | 20 5088524 | A2 | 6/2015 |
| WO | 2015088524 | A2 | 6/2015 |
| WO | 2015160424 | A1 | 10/2015 |
| WO | 2015169676 | A2 | 11/2015 |
| WO | 2016081718 | A1 | 5/2016 |
| WO | 2017/065767 | A1 | 4/2017 |
| WO | 2017065752 | A1 | 4/2017 |
| WO | 2017100939 | A1 | 6/2017 |
| WO | 2018057011 | A1 | 3/2018 |

* cited by examiner

METHOD AND STIMULATION SLEEVE FOR WELL COMPLETION IN A SUBTERRANEAN WELLBORE

FIELD OF THE INVENTION

The present invention relates to a method and a stimulation sleeve for well completions in a subterranean wellbore. The stimulation sleeve comprises a housing having a through channel with a first end and a second end, and one or more flow ports, and a sliding sleeve disposed axially movable within the housing to open or close said flow ports, wherein said sliding sleeve is equipped with at least a first seat for receipt of an obturator to partially or fully close fluid communication in the through channel of the housing.

The present invention relates to the field of construction of wells that access subterranean hydrocarbon-bearing formations, where the productivity of such wells is improved by hydraulic stimulation of multiple sections of the wellbore.

The hydraulic stimulation treatment may for instance take the form of hydraulic fracturing, where stimulation fluids are directed from the wellbore to the formation above the formation fracture gradient; or matrix stimulation, where stimulation fluids are directed from the wellbore to the formation below the formation fracture gradient.

For both hydraulic stimulation techniques, especially in horizontal wells with long sections of the wellbore within the formation, also known as the reservoir section, it is desirable to divide the reservoir section into multiple short compartments that can be accessed sequentially during the stimulation operation. Sequentially targeting short compartments of the reservoir section allows the operator to better control over where the stimulation fluids are entering the formation, resulting in better production contribution across the entire reservoir section after the stimulation.

The present invention provides a system and method for sequentially targeting single entry points for stimulation fluids to access the formation.

BACKGROUND OF THE INVENTION

The present invention enables a sequential stage treatment of the entire wellbore, one sliding sleeve at a time, without requiring any type of intervention between stages. In addition, this invention does not result in barriers or restrictions that must be removed following the final treatment stage. The invention ensures that wellbore and stimulation fluids are directed to individual entry points one at a time.

DISCLOSURE OF THE STATE OF ART

Current methods of sequentially targeting short compartments, also known as stages, of the reservoir section are designed to target the deepest compartments first, and subsequently targeting shallower compartments. These methods require pumping operations to stop after stimulation of each stage. Before the next stage treatment, the previous one must be isolated to prevent stimulation fluids from entering the already-treated entry points.

In the case of plug-and-perforated well designs, isolation is achieved by using wireline to intervene in the wellbore to set a bridge plug above the previously treated compartment, and then new perforation clusters are placed above the bridge plug to create the entry points for the next stimulation stage.

In the case of ball or obturator-operated sliding sleeve well designs, each stage consists of sliding sleeves which are ported to provide entry points for wellbore fluids to enter the formation. The sliding sleeves begin in a closed position, where the ports are isolated and do not allow a fluid path between the wellbore and the formation. The sliding sleeves are opened by dropping an obturator into the wellbore and pumping it down to the location of the sleeves. Each sleeve has a seat which matches in size to the obturator that is dropped. When the obturator contacts the seat, hydraulic pressure is applied to the wellbore above the obturator and differential pressure across the obturator drives the sleeve down to expose the ports and allow fluid to enter the formation. To target individual compartments with obturator-operated sliding sleeves, different combinations of obturator and seat dimensions must be used for each stage. Smaller obturator and seat dimensions are used for the deepest stage, with sequentially larger obturator and seat dimensions for subsequent stages. Isolation between stages is achieved when the obturator lands in a seat between the stages. Both of the well designs described above result in a well with multiple barriers or restrictions that must be removed by wireline or coiled tubing intervention after the final stimulation stage is complete.

A third well design utilizes coiled tubing-operated sliding sleeves and eliminates the resulting restrictions; but this technique requires coiled tubing to remain in the wellbore during the stimulation, which introduces significant risk to the operation, especially as the number of compartments is increased.

WO 2015/039697 A1 relates to system and method for delaying actuation using a destructible impedance device. In one embodiment, a delayed actuating system can comprise a base pipe comprising a first portion of an orifice, a sliding sleeve around the base pipe, the sliding sleeve comprising a second portion of said orifice, further said sliding sleeve manoeuvrable into a first position, wherein said first portion of said orifice rests at least partially over said second portion of said orifice, a second position, a distance away from said second position. Further, the delayed actuating system can comprise a biasing device biasing the sliding sleeve toward the second position, and a destructible impedance device at least partially inside said orifice, the destructible impedance device preventing the sliding sleeve from leaving the first position.

US 2017/058642 A1 disclose a catch-and-engage tool conveyed with a well casing for use in a wellbore comprising an outer housing having flow ports therethrough, a functioning apparatus disposed within the outer housing comprising a movable member/sleeve and a holding device, a blocking apparatus disposed within the outer housing comprising a blocking member configured to block one or more flow ports in a first position, a seating apparatus positioned upstream of the blocking apparatus configured to form a seat in the tool. When a ball deployed into the well casing passes through the tool in a downstream direction and moves back in an upstream direction, the restriction element engages onto the holding device and moves the movable member such that a port in exposed to uphole pressure and the blocking member travels to a second position in a reverse direction unblocking flow ports and enabling fluid communication to the wellbore.

US 2012/234545 A1 disclose a valving system including a tubular and a sleeve slidably engaged with the tubular having a seat thereon. The sleeve is configured to occlude flow from an inside of the tubular to an outside of the tubular when in a first position, allow flow between an inside of the tubular and an outside of the tubular at a first location upstream of the seat and a second location downstream of the seat when in a second position, and allow flow between an inside of the tubular and an outside at the tubular at the first location and not the second location when in a third position. The valving system also includes a disappearing member in operable communication with the tubular and the sleeve configured to prevent movement of the sleeve to the third position until disappearance thereof.

OBJECTS OF THE PRESENT INVENTION

It is an object to enable sequential stage treatment of the entire wellbore, one sliding sleeve at a time, without requiring any type of intervention between stages.

It is a further object to provide a stimulation sleeve with a time delay in order to hold a flow port open after activation and during the time delay, and which closes when the time delay has completed, preferable by using only one obturator.

Several configurations can be derived from the present invention:

1. Stimulation sleeve with delayed closing sequence—left closed, opened by intervention.

2. Stimulation sleeve with delayed closing sequence—left in a third closed position, opened by dissolvable/disintegrating technology, or a dual-action-type plug, which can be removed using pressure cycles.

The invention can be used for any type of multi-stage stimulation, including hydraulic fracturing treatment.

SUMMARY OF THE INVENTION

The above objects are achieved with a method for well completion in a subterranean wellbore, comprising the steps:

running a tubing with a number of stimulation sleeves into the wellbore, each stimulation sleeve comprises a housing having a through channel with a first end and a second end, one or more flow port and a sliding sleeve disposed axially movable within the housing to open or close said flow ports, dropping an obturator into a well stream in the tubing and to land the obturator on a first obturator seat to partially or fully close fluid communication in the through channel of the housing, build up pressure to shift the sliding sleeve axially in the housing to open the flow ports, engaging a time delay mechanism for controlled travel of the sliding sleeve in the housing to hold the flow ports open a predetermined time, closing the flow ports after the sliding sleeve has moved the predetermined time, and retracting the obturator seat to release the obturator.

The flow ports can be opened by aligning longitudinal slits in the sliding sleeve with the flow ports, and the flow ports can be closed by allowing the longitudinal slots in the sliding sleeve to move out of alignment with the flow ports.

A second obturator can be landed in a second obturator seat, said second obturator seat being located upstream of the first obturator seat, and to build up pressure to shift the sliding sleeve axially in the housing to re-open the flow ports.

The second obturator seat can be retracted to release the second obturator after the production ports in the sliding sleeve are aligned with the flow ports.

The production ports in the sliding sleeve can be filled with a dissolvable material that dissolves when exposed to well fluids.

The production ports in the sliding sleeve can mechanically be opened, for instance by one or more dual action plugs subjected to pressure cycles.

A shifting tool can be conveyed into the wellbore to shift the stimulation sleeves to open position after the stimulation is completed.

Thereafter a second obturator can be dropped into the well stream in the tubing and to land the second obturator on the obturator seat to partially or fully close fluid communication in the through channel of the housing; build up pressure to shift the sliding sleeve axially in the housing to close the flow ports by moving the longitudinal slits in the sliding sleeve out of aligning with the flow ports; engaging the time delay mechanism for controlled travel of the sliding sleeve in the housing to hold the flow ports open a predetermined time; and retract the obturator seat to release the obturator.

The above objects are also achieved with a stimulation sleeve for well completion in a subterranean wellbore, comprising a housing having a through channel with a first end and a second end, and one or more flow ports; and a sliding sleeve disposed axially movable within the housing to open or close said flow ports, wherein said sliding sleeve is equipped with at least a first obturator seat for receipt of a obturator to partially or fully close fluid communication in the through channel of the housing; and a time delay mechanism to allow the sliding sleeve to axially travel in the housing at a predetermined speed to open or close said flow ports.

The sliding sleeve can comprise a first closed part for closing the flow ports and a second partially open part equipped with longitudinal slits for alignment with the flow ports, to open the flow ports.

The sliding sleeve can comprise a third closed part for closing the flow ports.

The sliding sleeve may further comprise a fourth partially open part equipped with production ports for alignment with the flow ports to open the flow ports.

The production ports in the sliding sleeve can be filled with a dissolvable material that dissolves when exposed to well fluids.

The production ports in the sliding sleeve can mechanically be opened, for instance by comprising one or more dual action plugs that can be removed using pressure cycles.

The obturator seat can comprise a plurality of radially placed and retractable plungers being activated by the movement of the sliding sleeve. At least one gasket can be placed upstream of said plungers.

The sliding sleeve can comprise a second obturator seat for receipt of a second obturator, said second obturator seat being located upstream of the first obturator seat, in order to build up pressure and to shift the sliding sleeve axially in the housing to open the flow ports by aligning the production ports in the sliding sleeve with the flow ports.

The time delay mechanism can be accommodated in a hydraulic chamber on the inner surface of the housing, and comprise a piston surface area and longitudinal holes, each of which contains a hydraulic metering orifice which separates two sides of the piston.

The time delay mechanism can be accommodated in a hydraulic chamber on the inner surface of the housing, and comprise for instance a timing valve with a porous filter media rod that allows hydraulic fluid to pass from one side of the chamber to the other side of the chamber.

The porous filter media rod can be connected to a spring for regulation of how much of the porous media rod that is exposed to the hydraulic fluid.

DESCRIPTION OF THE DIAGRAMS

Embodiments of the present invention will now be described, by way of example only, with reference to the following diagrams wherein:

FIG. 1 shows a first embodiment of the present invention.

FIG. 2*a*-2*e* show operation of the first embodiment of the invention.

FIG. 3 shows a second embodiment of the present invention.

FIG. 4*a*-4*h* show operation of the second embodiment of the invention.

Figure 7A:
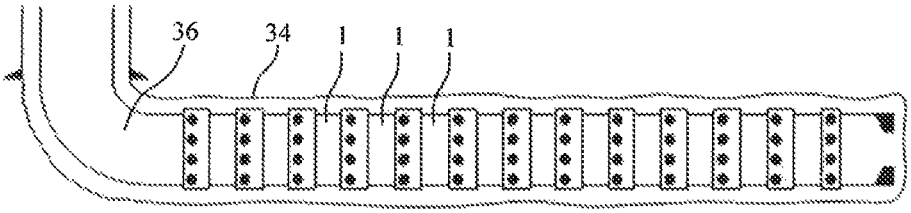
Figure 7B:
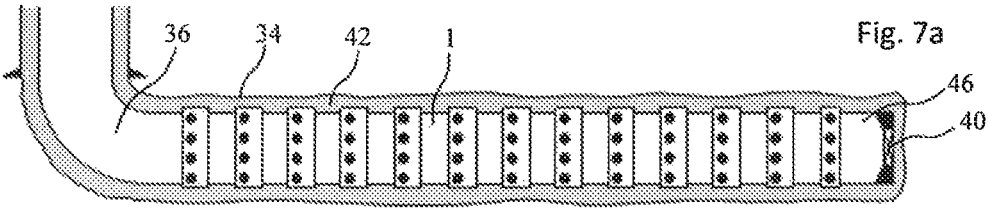
Figure 7C:
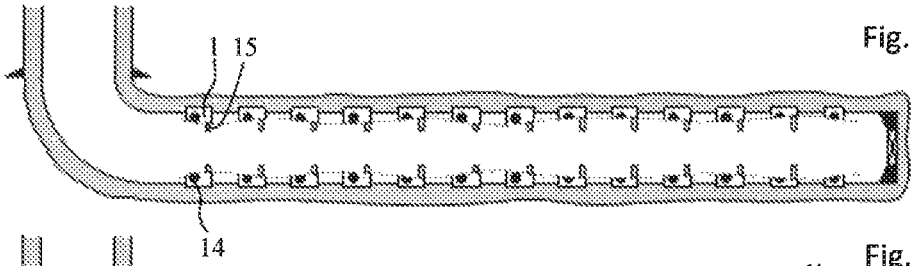
Figure 7D:
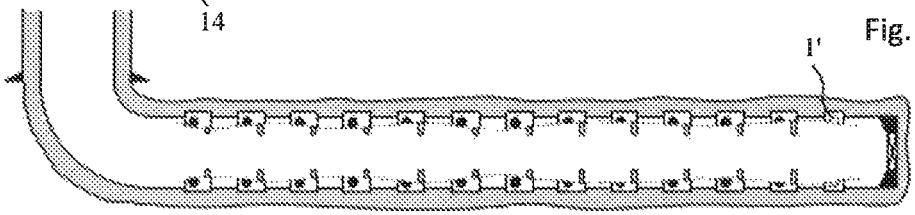
Figure 7E:
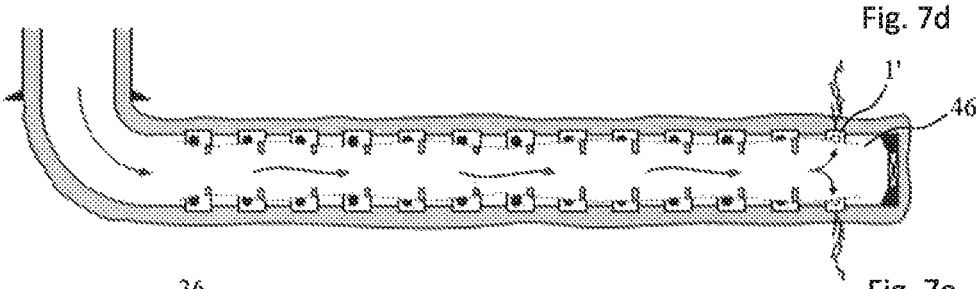
Figure 7F:
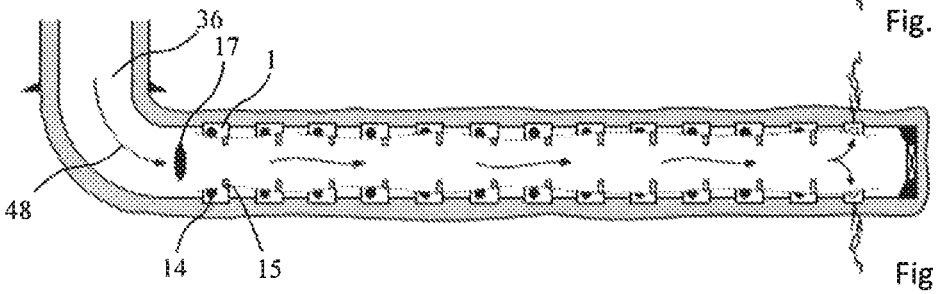
Figure 7G:
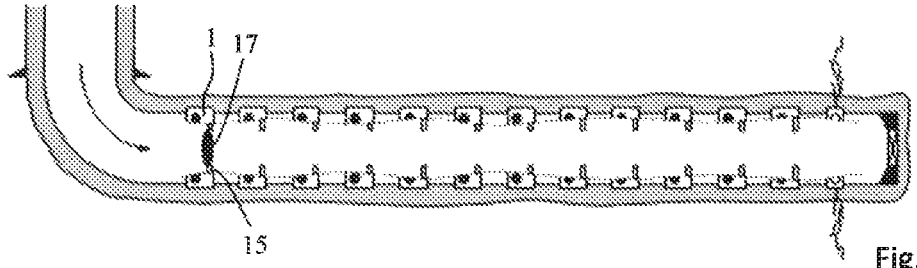
Figure 7H:
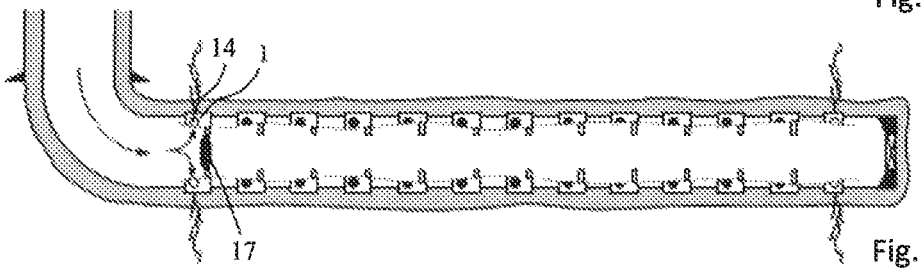
Figure 7I:
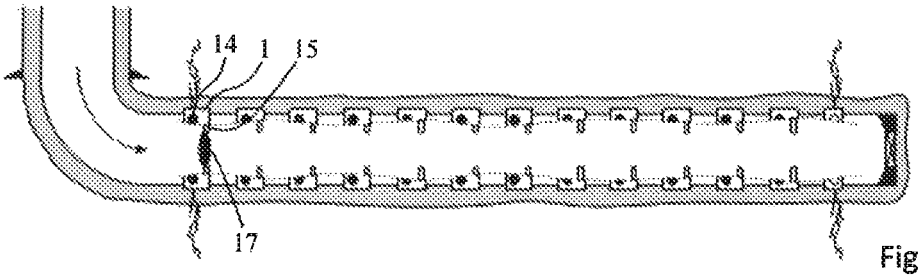
Figure 7J:
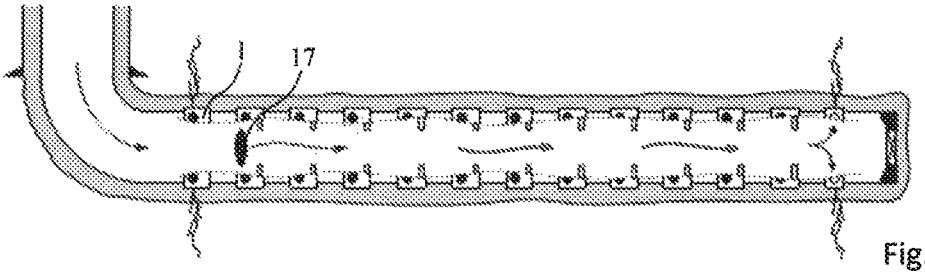
Figure 7K:
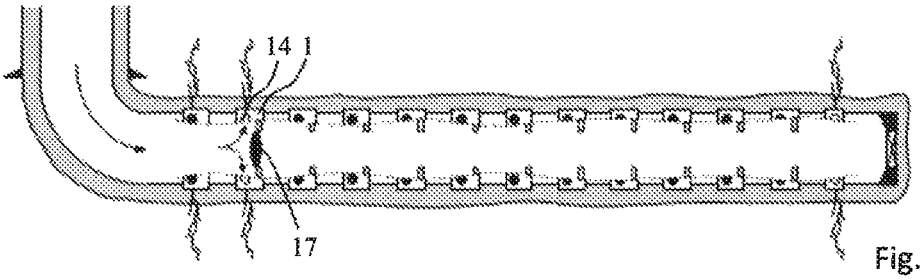
Figure 7L:
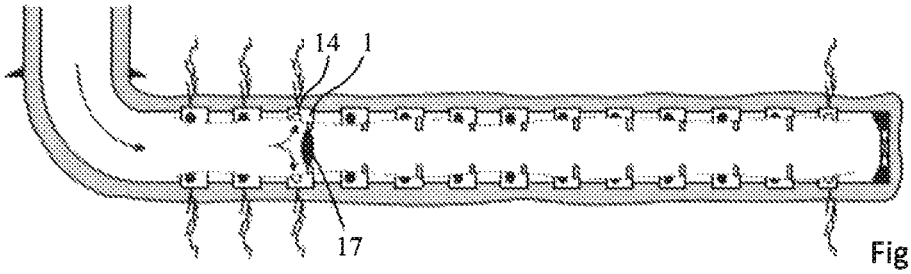
Figure 7M:
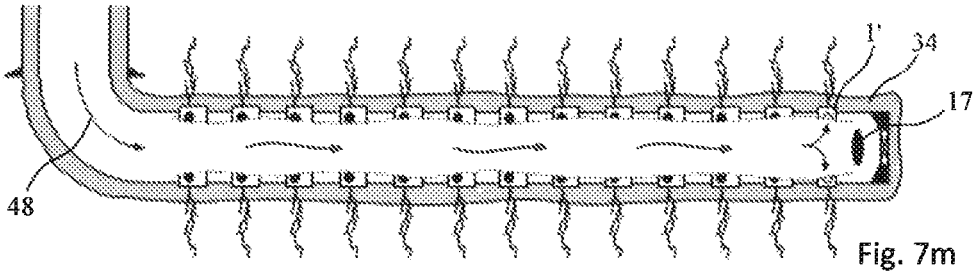
Figure 7N:
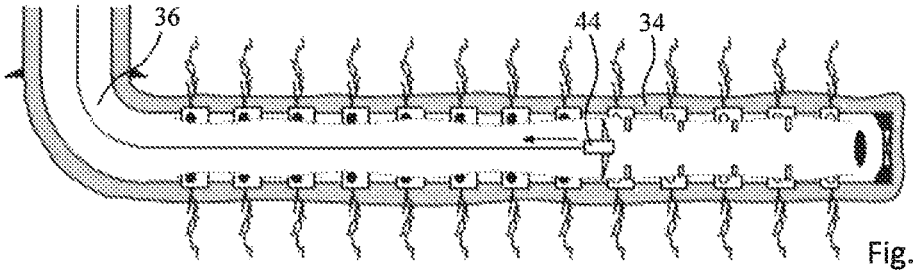
Figure 7O:
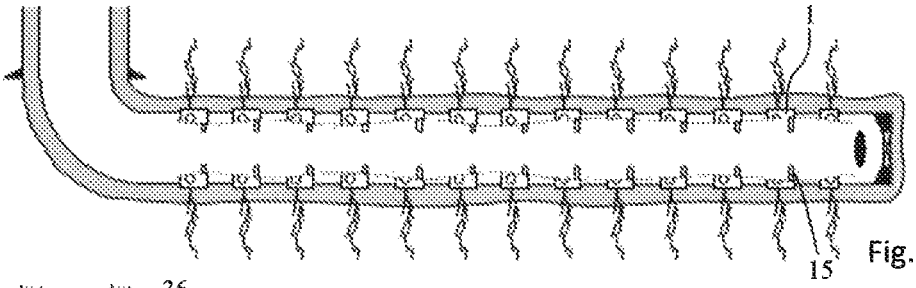
Figure 7P:
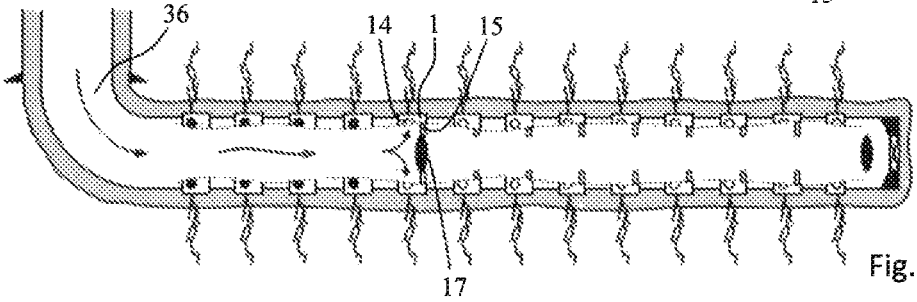

FIG. 7*a*-7*p* show application of the first embodiment of the invention.

FIG. 8*a*-8*e* show application of the second embodiment of the invention.

DESCRIPTION OF PREFERRED EMBODIMENTS OF THE INVENTION

Figure 1:
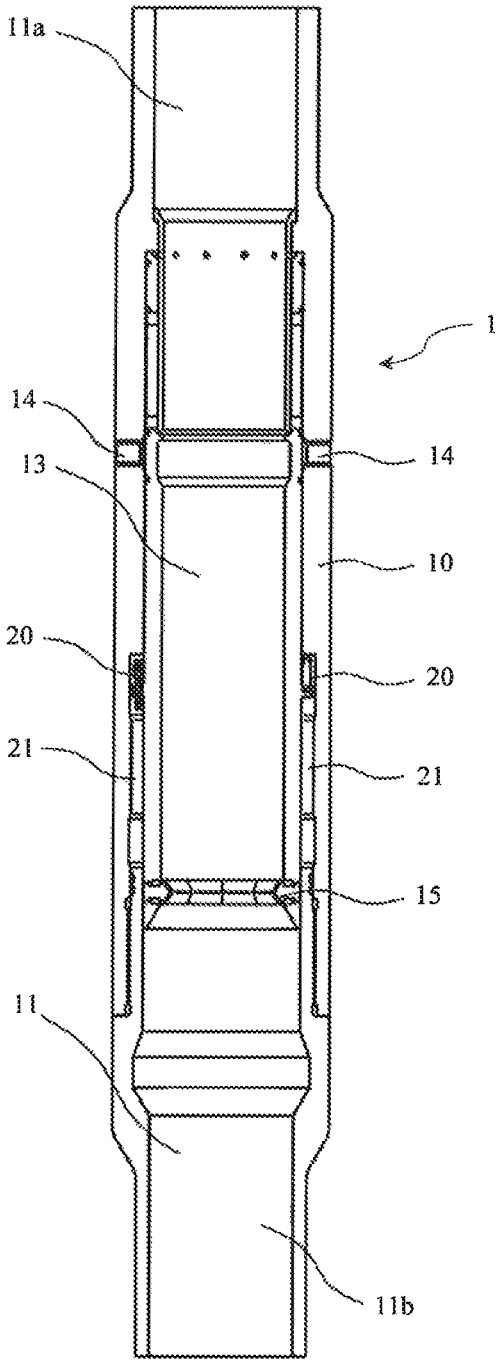
Figure 3:
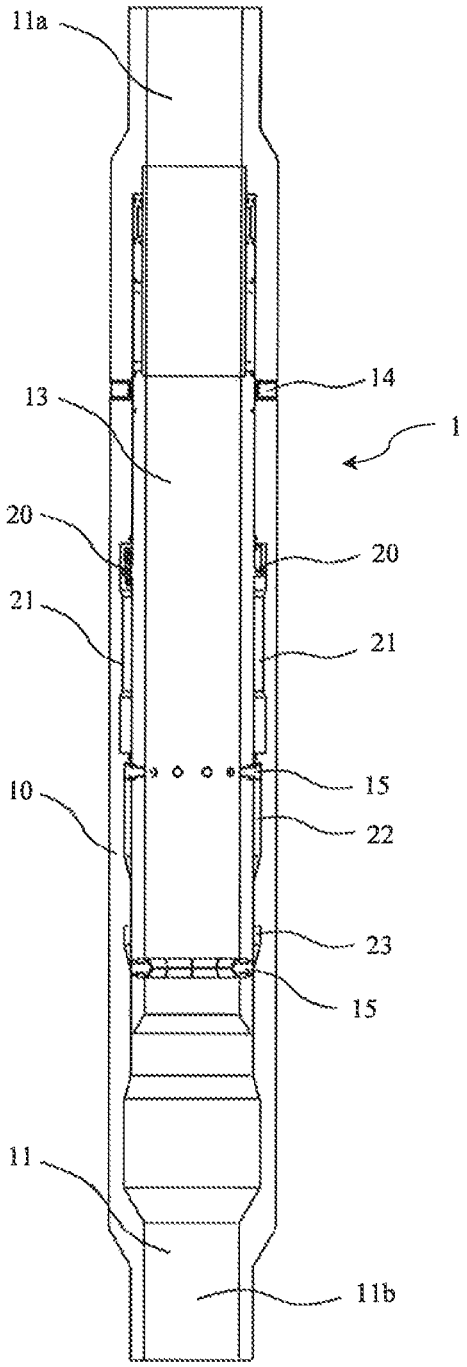

The present invention relates to a stimulation sleeve 1 for well intervention in a subterranean wellbore 34, and comprises a housing 10 having a through channel 11 with a first end 11*a* and a second end 11*b*, one or more flow ports 14, and a sliding sleeve 13 disposed axially movable within the housing 10 to open or close the flow ports 14. The sliding sleeve 13 is equipped with at a first landing profile in the form of for instance an obturator seat 15, for instance a ball seat as seen in FIG. 1, for receipt of an obturator 17 in the form of for instance a drop ball or dart, to partially or fully close fluid communication in the through channel 11 of the housing 10. As seen in FIG. 3 the sliding sleeve 13 may also comprise a second landing profile in the form of a second obturator- or ball seat 15. The stimulation sleeve 1 further comprises a time delay mechanism 20 to allow the sliding sleeve 13 to axially travel or being displaced in the housing 10 at a predetermined speed to open or close the flow ports 14.

Figure 4G:
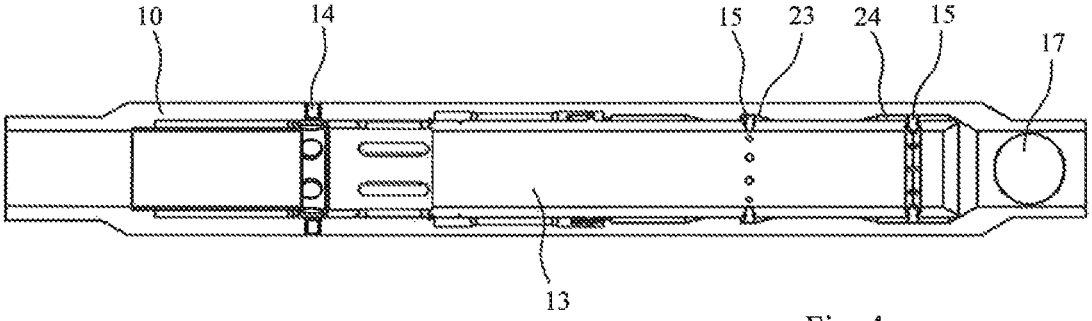
Figure 5:
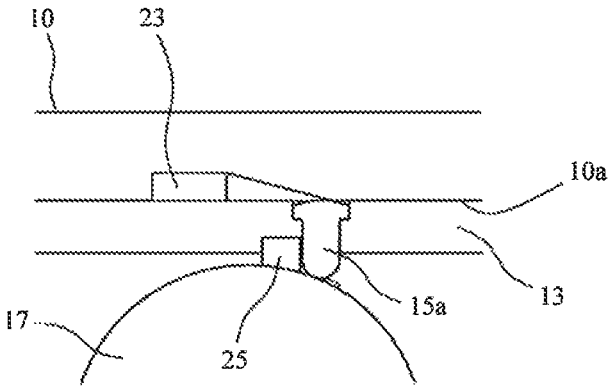
FIG. 5 shows in detail an example of a landing profile of the invention.

An example of the landing profile in the form of an obturator seat 15 is shown in more detail in FIG. 5, and comprises in one embodiment a plurality of spring loaded plungers 15*a* placed radially in the sliding sleeve 13. When the plungers 15*a* are forced against the inner surface 10*a* of the housing 10 they are pushed out into the sliding sleeve 13, i.e. the plungers 15*a* protrude inwardly in the sliding sleeve 13. The housing 10 may comprise a longitudinal compartment or cavity 23, 24 on the inside surface 10*a*, and when the plungers 15*a* in the sliding sleeve 13 passes the cavity 23, 24, the plungers 15*a* are allowed to retract to let the obturator 17 pass. As seen in FIG. 2*e* the plungers 15*a* are retracted in the cavity 24 and the obturator 17 can pass. FIG. 4*g* shows that the first sett of plunger 15*a*, being the first obturator seat 15, are retracted in the cavity 24 and the second sett of plungers 15*a*, being the second obturator seat 15, are retracted in the cavity 23.

In a further embodiment the obturator seat 15 can be made of a dissolvable material.

Figure 6:
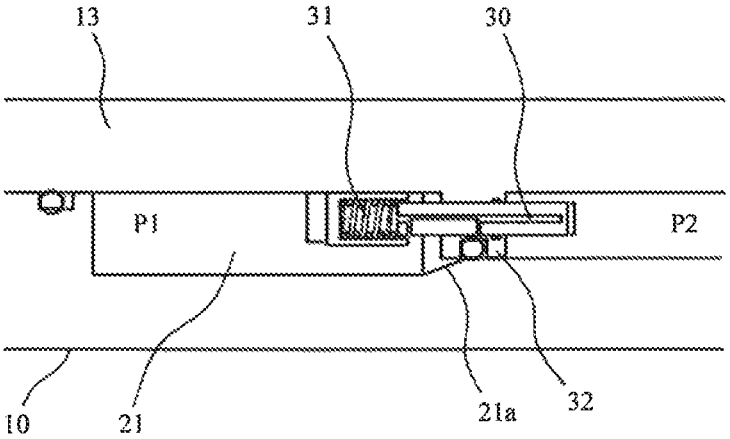
FIG. 6 shows in detail an example of a time delay mechanism of the invention.

An example of a time delay mechanism 20 is shown in more detail in FIG. 6. The time delay mechanism 20 is connected to the sliding sleeve 13 and is accommodated in a longitudinal chamber or cavity 21 on the inside surface 10*a* of the housing 10. The cavity 21 is filled with a hydraulic fluid, such as oil. When the sliding sleeve 13 is axially displaced in the housing 10 the time delay mechanism 20 will hit a shoulder 21*a* and pressurized oil will be forced from one side P2 of the cavity 21 to the other side P1 of the cavity 21. Hence, the sliding sleeve 13 will travel at a predetermined speed. The time delay mechanism 20 can for instance comprise a timing valve with a porous filter media rod 30 that allows the pressurized oil to pass from P2 to P1. A spring 31 can regulate how much porous media rod 30 that is exposed, and the total permeability will change with delta pressure and the sliding sleeve 13 will travel at constant speed regardless of delta pressure between P1 and P2. The time delay mechanism 20 may further comprise a gasket in the form of for instance an O-ring 32 that seals against the inner surface 10*a* of the housing 10.

The time delay mechanism 20 can be a metering device accommodated in a hydraulic chamber on the inner surface of the housing 10, and comprise a piston surface area and longitudinal holes, each of which contains a hydraulic metering orifice which separates two sides of the piston.

The invention takes tubular form with an internal diameter which makes up a portion of the wellbore, and an outside diameter which is exposed to the annulus and formation. It is connected end to end with the lower completion tubulars. Any number of stimulation sleeves 1 can be deployed at intervals along the lower completion tubular string, all of which can function in the same way. The stimulation sleeve 1 according to the invention comprises the housing 10 with flow ports 14 that hydraulically connect the wellbore 34 to the formation. The flow ports 14 can be open to allow flow to or from the formation, or closed to prevent flow and contain pressure.

The position of the inner sliding sleeve 13 determines whether the flow ports 14 are open or closed.

The inner sliding sleeve 13 of a first embodiment of the invention shown in FIGS. 1 and 2*a*-2*e* comprises an upper section with three distinct surfaces 13*a*-13*c* that can be located across the housing flow ports 14, depending on the sliding sleeve 13 positions. The lower surface 13*a* is solid, the middle surface 13*b* has machined holes in the form of for instance longitudinal slits 18, and the upper surface 13*c* is solid. When the tool is conveyed into the well, the inner sliding sleeve 13 is in its uppermost first position and the solid surface 13*a* blocks the housing flow ports 14, preventing flow through them. If the sleeve 13 moves down into a second position, the middle surface 13*b* can be aligned with the flow ports 14, and the longitudinal slits 18 in the sleeve 13 allows flow from the wellbore 34 through the flow ports 14 and into the formation. If the sleeve 13 moves down further past the second position, the upper surface 13*c* is then aligned with the flow ports 14 in a third position and contains pressure within the wellbore 34.

The inner sliding sleeve 13 has a middle section which comprises the time delay mechanism 20 in the form of for instance a piston surface area and machined longitudinal holes, each of which contains a hydraulic metering orifice which separates the two sides of the piston, as explained above in relation to the time delay mechanism 20. On both sides of the piston surface area is the hydraulic chamber 21 filled with hydraulic fluid. This hydraulic chamber 21 is balanced in pressure with the wellbore 34 under all steady state conditions.

The inner sliding sleeve 13 has a lower section which comprises the landing profile, as for instance explained above in relation to the obturator seat 15. The landing profile can be extended or retracted, depending on the position of the inner sleeve 13. While the sleeve 13 is in the first and second positions, the landing profile is extended, meaning the internal diameter is reduced and prevents any obturator of larger diameter from passing through it. When the sleeve 13 is in the third position, the landing profile is retracted to a larger ID, allowing any obturator of smaller diameter to pass through it.

If any obturator 17 with a smooth surface is prevented from passing the landing profile 15, the wellbore section above the obturator 17 is isolated from the wellbore section below the obturator. If pressure above the obturator is higher than the pressure below the obturator, a piston force results and acts to drive the inner sliding sleeve 13 in the downward direction. The speed at which the sliding sleeve 13 moves is controlled by the hydraulic orifices, i.e. the time delay mechanism 20, which allow the hydraulic fluid to meter from one side of the sleeve piston to the other side.

During well operations, one or more stimulation sleeves 1 are deployed into the well. Once the tubular string is positioned at the target depth, cementing operations can be conducted to place cement in the annulus. Alternatively to cement, the operator can choose to use open-hole packers to create the annular isolation between the sleeves and the rest of the well.

After annular isolation is established, the wellbore is pressure tested against the closed stimulation sleeves 1 and the remaining tubulars. Toe prep is then conducted, either through an intervention-based toe perforation method, or by opening a remotely operated toe sleeve, thereby creating a flow path at the bottom of the well.

When it is desirable to begin the stimulation operation, an obturator 17 is deployed into the well stream 48 of the wellbore 34 and pumped down to the uppermost stimulation sleeve 1. The obturator 17 makes contact with the obturator seat 15 in the stimulation sleeve 1, which in turn initiates the metering shift of the sliding sleeve 13 to the second position where the flow ports 14 are opened.

The stimulation stage is pumped through the open flow ports 14. Meanwhile, the sliding sleeve 17 continues to shift downward. The time at which the flow ports 14 remain open can be determined by using different number of orifices and/or using different permeability factor in the time delay mechanism 20.

At the predetermined time delay, the sliding sleeve 13 moves into the third position where the flow ports 14 are isolated. At the same time, the landing seat 15 retracts and allows the obturator 17 to pass the first stimulation sleeve 1 to the second stimulation sleeve 1 in the sequence, and the stimulation stage operation is repeated.

When the obturator 17 is released from the final stimulation sleeve 1 in the sequence, it continues down to the bottom of the well below the toe perforations or toe sleeve. Alternatively, it can land in a fixed landing profile above the toe sleeve, thereby creating a pressure tight tubular system, which may allow the operator to perform wellhead work without being exposed to a live well.

To open the stimulation sleeves 1 for production, wireline or coiled tubing intervention is performed using a shifting tool which locates inside the shifting profile of each sleeve. The sliding sleeve 13 is mechanically shifted to the open position. A checking valve allows the sleeve 13 to be shifted upwards without a hydraulic delay.

Figure 2A:
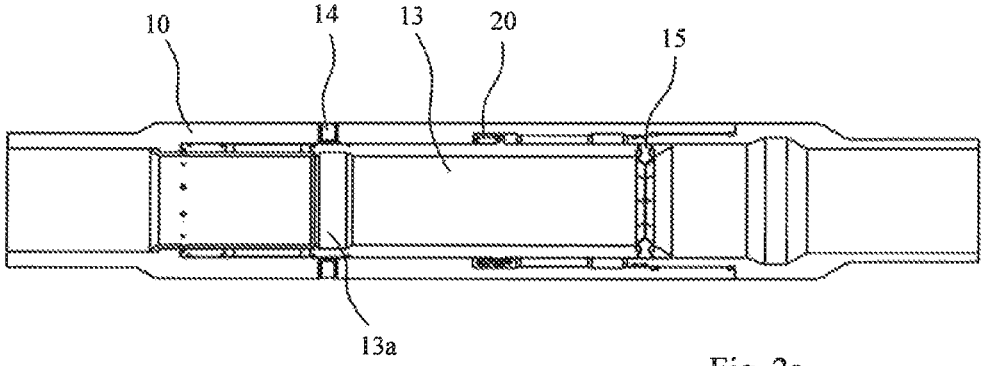
Figure 2B:
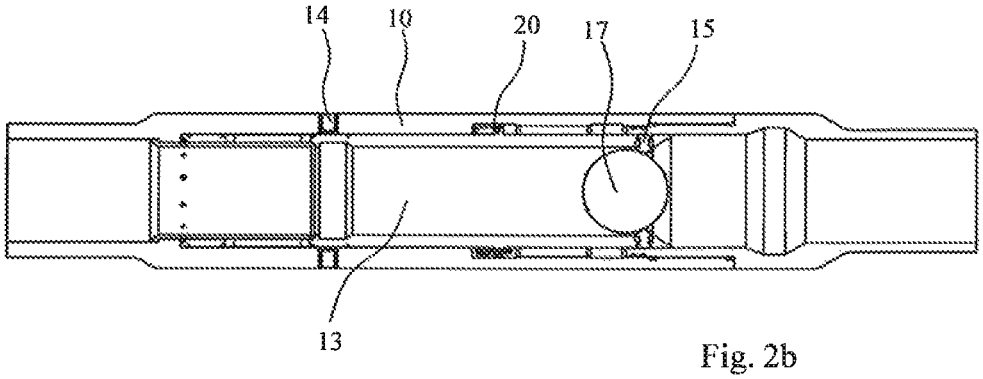
Figure 2C:
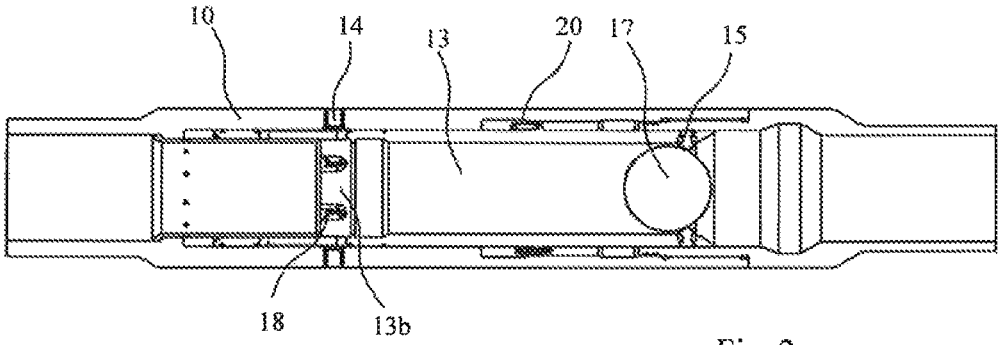
Figure 2D:
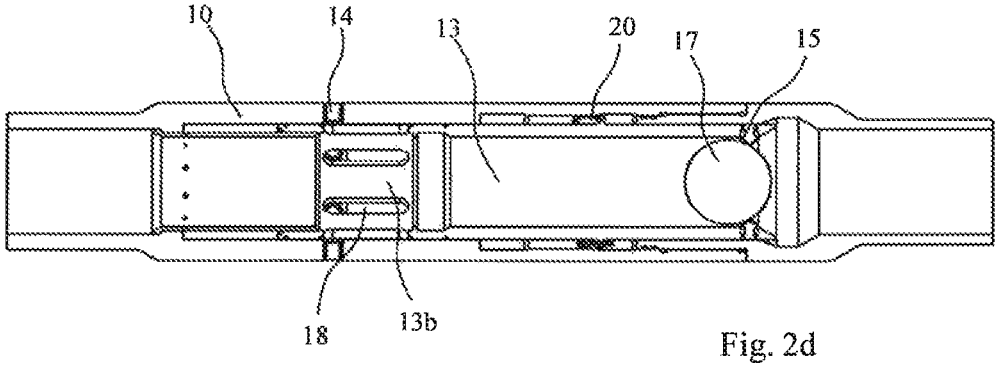
Figure 2E:
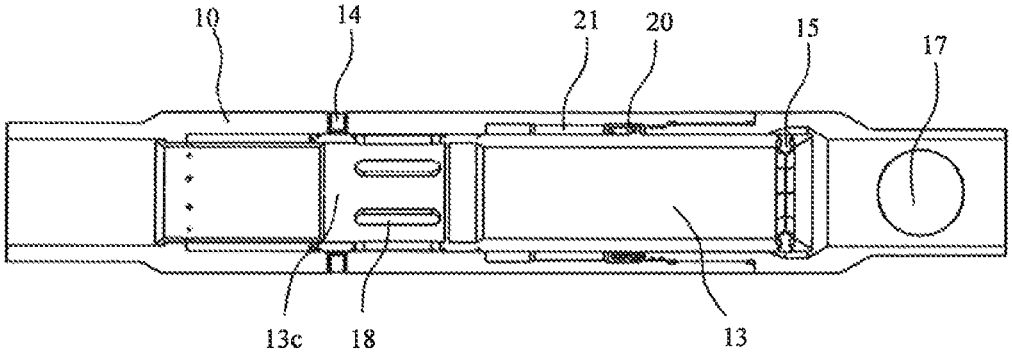

FIG. 2*a*-2*e* shows the above procedure of using the first embodiment. In FIG. 2*a* the stimulation sleeve 1 is run into the wellbore 34. In FIG. 2*b* the obturator 17 is landed in the obturator seat 15 and pressure is built up. The sliding sleeve 13 is thereafter shifted in the housing 10, as seen in FIG. 2*c*, and the flow ports 14 are open and the time delay mechanism 20 is activated. In FIG. 2*d* the sliding sleeve 13 shifts to the end of open position, and in FIG. 2*e* the sliding sleeve 13 moves to closed position, the obturator seat 15 retracts and the obturator 17 is released. The obturator 17 moves to the next stimulation sleeve 1.

FIGS. 3 and 4*a*-4*h* shows a second embodiment of the invention. The alternative configuration of the invention comprises a second landing profile in the form of a second obturator seat 15 which remains retracted in the first and second positions, but is then extended in the third position. The second obturator seat 15 can be used to shift the sliding sleeve 13 to a fourth open position by deploying a second obturator 17 into the well stream 48 of the wellbore 34 and pumping it through all the stimulation sleeves 1. In this configuration, it is desirable to prevent fluid leak off through the fourth position production ports 19 until all stimulation sleeves 1 have been shifted to the fourth position. This can be accomplished by using dissolvable material for plugs that are installed into the fourth position production ports 19 as a temporary barrier.

Another way to prevent leak off is to use dual action type plug design which are removed hydraulically from the fourth position production ports 19 by under balancing the well when the well is initially put on production. Flow from the formation into the wellbore removes the plugs and the well is produced as normal.

Figure 4A:
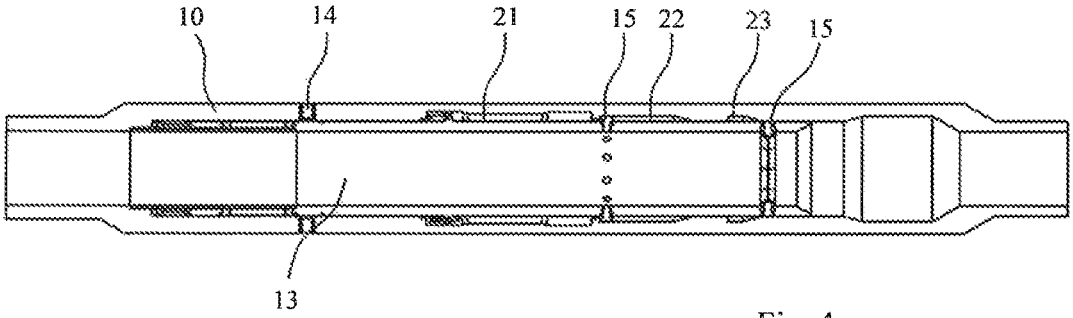
Figure 4B:
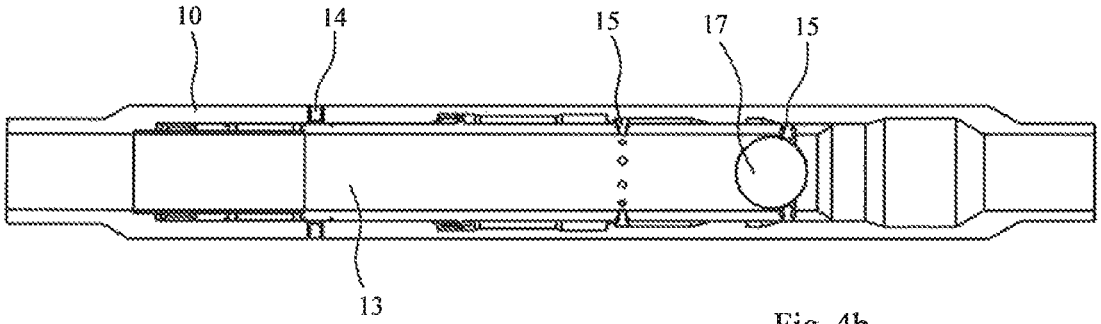
Figure 4C:
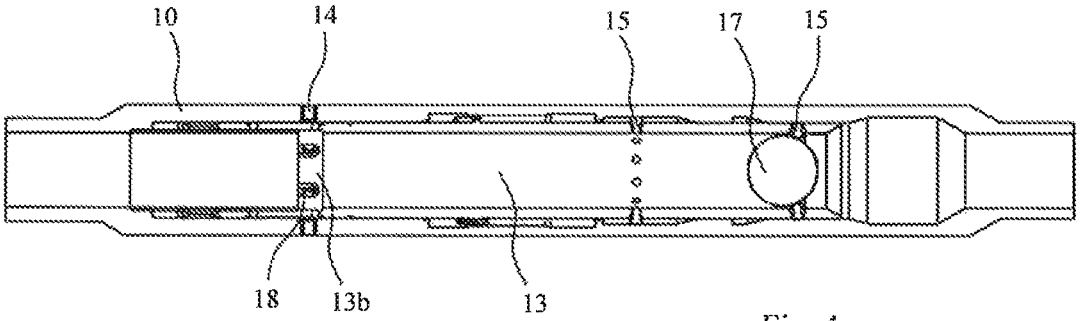
Figure 4D:
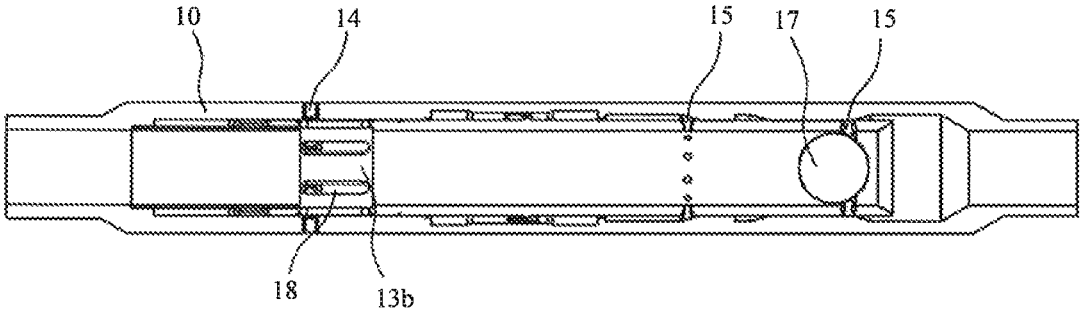
Figure 4E:
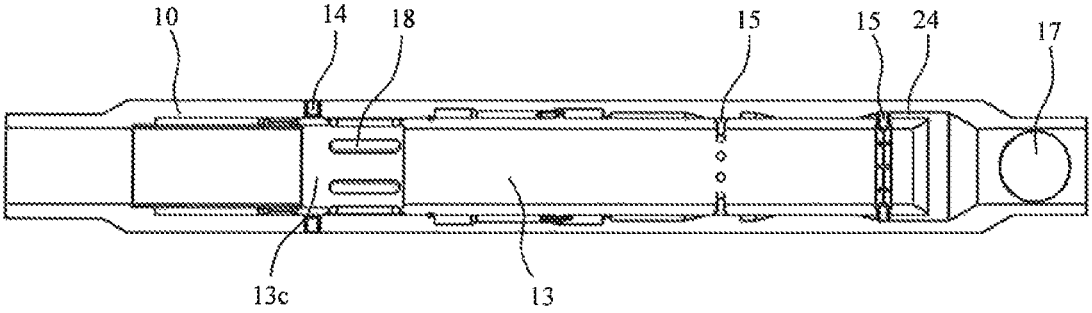
Figure 4F:
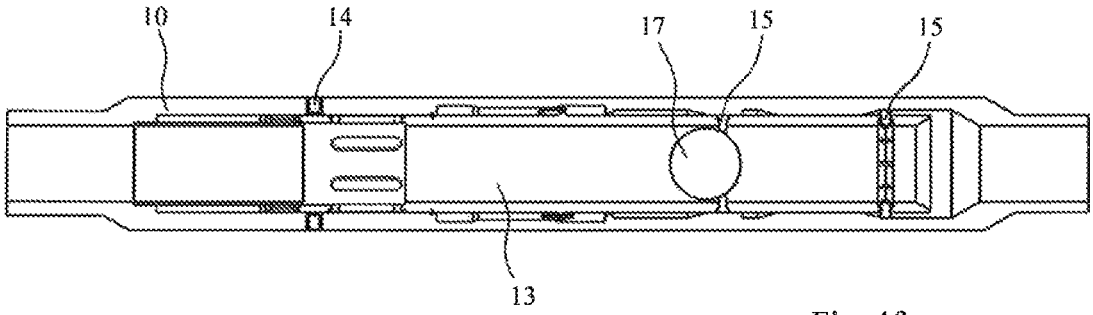
Figure 4H:
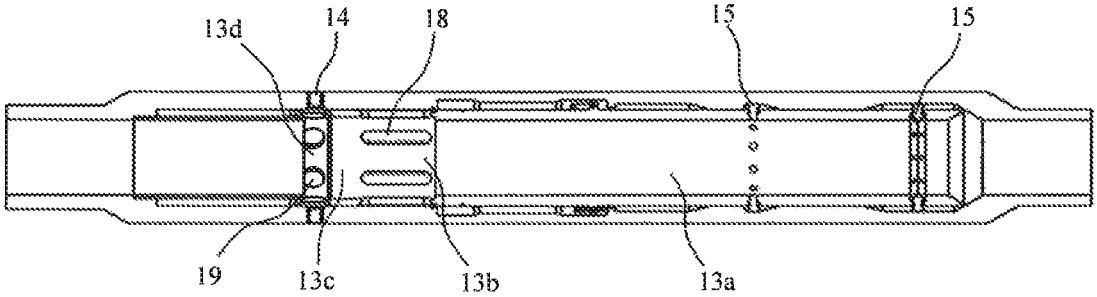

In FIG. 4*a* the stimulation sleeves 1 are run into the wellbore 34. The obturator 17 is in FIG. 4*b* landed in the lower obturator seat 15 and pressure is built up. In FIG. 4*c* the sliding sleeve 13 is shifting to open position and the time delay mechanism 20 is engaged. FIG. 4*d* shows that the sliding sleeve 13 has moved to end of open position, and in FIG. 4*e* the sliding sleeve 13 moves to closed position, the lower obturator seat 15 retracts and the obturator 17 moves to the next stimulation sleeve 1 and repeats the procedure. In FIG. 4*f* the second obturator 17 has landed in the upper obturator seat 15 and pressure is built to shift the sliding sleeve 13 to open position. In FIG. 4*g* the sliding sleeve has reached opening position and the dissolvable productions ports 19 are exposed to well fluid. The upper obturator seat 15 retracts and the obturator 17 is released and moves to the next stimulation sleeve 1 and repeats the procedure. In FIG. 4*h* the dissolvable material in the productions ports 19 are dissolved and production can start from that zone.

In all embodiments, mechanical wireline or coiled tubing intervention can be used to shift the sliding sleeve 13 back to the first closed position, to allow the stimulation operation to be repeated or to re-establish pressure integrity for other operations to take place.

Further, the production ports 19 can be lined with carbide insert to prevent erosion during proppant pumping.

FIG. 7*a*-7*p* show application of the first embodiment of the invention. As previously explained, a tubing string 36 with a number of stimulation sleeves 1 is run into the wellbore 34 and in position, and completion cement 42 installed. Toe 46 is closed with for instance wiper dart/plug 40, as seen in FIGS. 7*a* and 7*b*. FIG. 7*c* shows a cut away of the lower completion string showing seats 15 of each stimulation sleeve 1. Opening pressure operated toe sleeve 1' to create injection point at toe 46 of wellbore 34 and to inject into toe sleeve 1' is shown in FIGS. 7*d* and 7*e*.

In FIGS. 7*f* and 7*g* the obturator 17 is pumped down to land on the first obturator seat 15 to isolate completion below. Pressure is applied above the obturator 17 to cause the flow ports 14 of the stimulation sleeve 1 to open and the first stimulation treatment can be performed, see FIG. 7*h*. After the planned time delay, the flow ports 14 of the stimulation sleeve 1 are isolated, as shown in FIG. 7*i*.

Continued application of pressure above the obturator 17 causes the obturator seat 15 to retract and releases the obturator 17, as shown in FIG. 7*j*. In FIG. 7*k* the obturator 17 lands in the obturator seat 15 of a second stimulation sleeve 1 and shift said stimulation sleeve 1 to open position.

FIGS. 7*l* and 7*m* show that the sequence continues for the remaining stimulation sleeves 1 in a manner identical to the first sleeve 1. At the end of stimulation, after all stimulation sleeves 1 have been treated, the obturator 17 is left at the bottom of the wellbore 34 and injection into the toe sleeve 1' can continue.

Optionally can a slick line, wireline or coiled tubing shifting tool 44 be conveyed to the bottom of the wellbore 34, and be pulled out to shift the stimulation sleeves 1 to open position, as shown in FIG. 7*n*. After retrieving the shifting tool 44 from the wellbore 34, the stimulation sleeves 1 are in the open position with the obturator seats 15 in extended to their original position, as seen in FIG. 7*o*.

FIG. 7*p* indicates that the well can be re-stimulated in nearly the same manner as the initial treatment by dropping another obturator 17. The difference is that all stimulation sleeves 1 begin in open position, and subsequently close after the time delay when the obturator 17 lands in each obturator seat 15. The second obturator 17 is dropped into the well stream 48 in the tubing 36 and the second obturator 17 land on the obturator seat 15 to partially or fully close fluid communication in the through channel 11 of the housing 10. Then building up pressure to shift the sliding sleeve 13 axially in the housing 10 to close the flow ports 14 by moving the longitudinal slits 18 in the sliding sleeve 13 out of aligning with the flow ports 14. For controlled travel of the sliding sleeve 13 in the housing 10 to hold the flow ports 14 open a predetermined time, the time delay mechanism 20 is engaged, and thereafter the obturator seat 15 is retracted to release the obturator 17. The procedure is repeated for all stimulations sleeves 1.

Figure 8A:
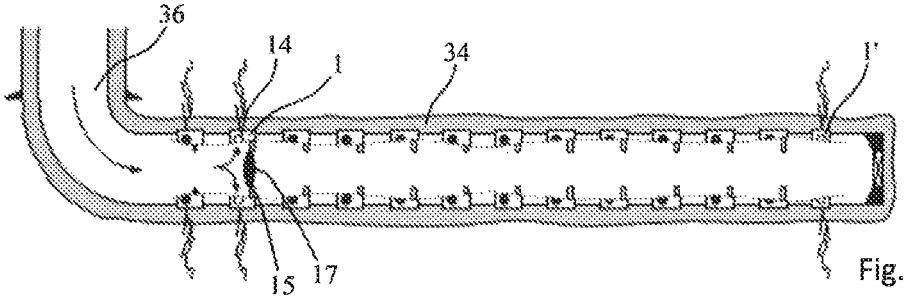
Figure 8B:
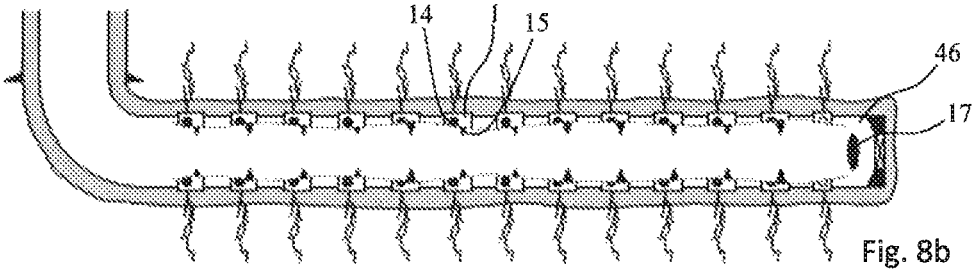

FIG. 8*a*-8*e* show application of the second embodiment of the invention. As mentioned previously, the second embodiment comprises a second obturator seat 15 that is extended when the first obturator seat 15 is retracted, as explained in relation to FIGS. 3 and 4*a*-4*h*, but otherwise is operated similar to the first embodiment. FIG. 8*b* shows that at the end of the final stimulation treatment, every stimulation sleeve 1 is closed and the second obturator seat 15 is extended.

Figure 8C:
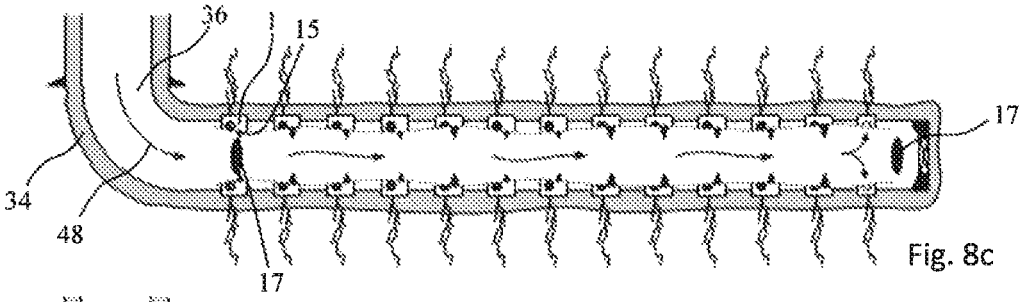
Figure 8D:
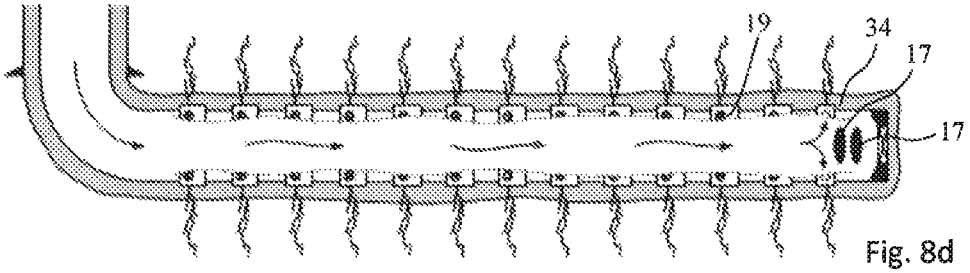
Figure 8E:
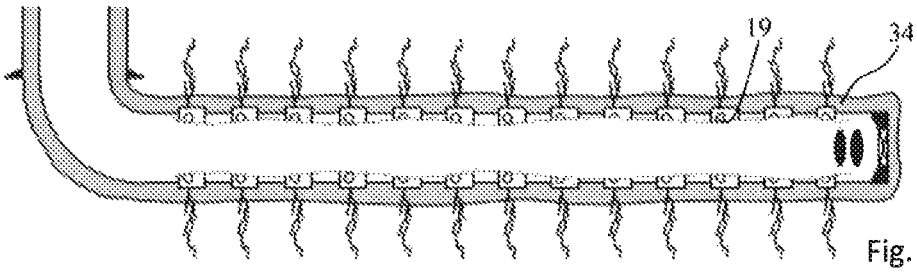

In FIG. 8*c* the second obturator 17 is pumped into the well stream 48 of the wellbore 34. The second obturator 17 lands in each obturator seat 15 and shifts each stimulation sleeve 1 to a third closed position, whereby a dissolvable or mechanical retaining device prevents pressure or flow communication from tubing to formation, i.e. for instance through the production ports 19. The second obturator seat 15 retracts at the end of this movement and releases the second obturator 17. In FIG. 8*d* the second obturator 17 is pumped to the bottom of the wellbore 34, at which time all of the stimulation sleeves 1 are in the third closed position. An appropriate dissolving fluid can be injected into the well in order to dissolve the retaining devises in the productions ports 19, if they are of dissolvable type, or appropriate pressure activation can be used to remove mechanical retaining devices, as previously explained. As seen in FIG. 8*e* the well will then have all sleeve- or productions ports 19 open to allow production across the reservoir section.

The invention claimed is:

1. A method for well completion in a subterranean wellbore, comprising the steps:

running a tubing string with one or more stimulation sleeves into the wellbore, each stimulation sleeve comprises a housing having a through channel with a first end and a second end, one or more flow ports, and a sliding sleeve disposed axially movable within the housing to open or close said flow ports, dropping an obturator into a well stream in the tubing string and landing the obturator on a first obturator seat to partially or fully close fluid communication in the through channel of the housing, building up pressure to shift the sliding sleeve axially in the housing to open the flow ports, engaging a time delay mechanism for controlled travel of the sliding sleeve in the housing for holding the flow ports open a predetermined time, closing the flow ports after the sliding sleeve has moved the predetermined time, and retracting the obturator seat to release the obturator, and conveying a shifting tool into the wellbore to shift the stimulation sleeve to open the flow ports after the obturator seat has retracted.

2. The method according to claim 1, comprising the steps:

opening the flow ports by aligning longitudinal slits in the sliding sleeve with the flow ports, and closing the flow ports by allowing the longitudinal slots in the sliding sleeve to move out of alignment with the flow ports.

3. The method according to claim 1, comprising the steps:

dropping a second obturator into the well stream in the tubing string, and landing the second obturator on the obturator seat to partially or fully close fluid communication in the through channel of the housing, building up pressure to shift the sliding sleeve axially in the housing to close the flow ports, engaging the time delay mechanism for controlled travel of the sliding sleeve in the housing for holding the flow ports open a predetermined time, and retracting the obturator seat to release the obturator.

* * * * *